US010512960B2

(12) United States Patent
Yamamoto et al.

(10) Patent No.: US 10,512,960 B2
(45) Date of Patent: Dec. 24, 2019

(54) EXTRUSION PRESS

(71) Applicant: Ube Machinery Corporation, Ltd., Ube-shi (JP)

(72) Inventors: Takeharu Yamamoto, Ube (JP); Masahiro Doki, Ube (JP)

(73) Assignee: Ube Machinery Corporation, Ltd., Ube (JP)

( * ) Notice: Subject to any disclaimer, the term of this patent is extended or adjusted under 35 U.S.C. 154(b) by 337 days.

(21) Appl. No.: 15/328,571

(22) PCT Filed: Jul. 1, 2015

(86) PCT No.: PCT/JP2015/068997
§ 371 (c)(1),
(2) Date: Jan. 24, 2017

(87) PCT Pub. No.: WO2016/017359
PCT Pub. Date: Feb. 4, 2016

(65) Prior Publication Data

US 2017/0225211 A1 Aug. 10, 2017

(30) Foreign Application Priority Data

Jul. 30, 2014 (JP) ..... 2014-154651

(51) Int. Cl.
*B21C 35/04* (2006.01)
*B21C 23/00* (2006.01)

(52) U.S. Cl.
CPC ..... *B21C 35/04* (2013.01); *B21C 23/002* (2013.01)

(58) Field of Classification Search
CPC ..... B21C 35/04; B21C 23/002
USPC ..... 72/254
See application file for complete search history.

(56) References Cited

U.S. PATENT DOCUMENTS

2010/0263428 A1* 10/2010 Yamamoto ..... B21C 23/21 72/255
2012/0244239 A1* 9/2012 Yamamoto ..... B21C 23/211 425/258

FOREIGN PATENT DOCUMENTS

| | | | | |
|---|---|---|---|---|
| JP | H04-367315 | A | 12/1992 | |
| JP | 06-071331 | A | 3/1994 | |
| JP | 07-241616 | A | 9/1995 | |
| JP | 2010-247175 | A | 11/2010 | |
| JP | 2013-091071 | A | 5/2013 | |
| JP | 2013-237092 | A | 11/2013 | |
| WO | 2011/074106 | A | 6/2011 | |
| WO | WO-2013061666 | A1 * | 5/2013 | ..... B21C 35/04 |

* cited by examiner

*Primary Examiner* — Teresa M Ekiert
(74) *Attorney, Agent, or Firm* — DLA Piper LLP (US)

(57) ABSTRACT

A shear device (21) of an extrusion press having a booster mechanism using an air cylinder or electric motor to supplement thrust to an amount corresponding to hydraulic pressure is provided. A fastening part pressing against a die stack (4) is configured by a booster mechanism using a lever and a shear guide (24) is pressed against a horseshoe (13) to fasten it in the extrusion direction. Further, a clearance between a surface of the die stack and a shear knife can be held constant. Also, a booster mechanism using a lever is employed for a tilt mechanism for the shear guide in the extrusion press.

2 Claims, 8 Drawing Sheets

EXTRUSION PRESS

TECHNICAL FIELD

The present invention relates to an extrusion press for extruding an aluminum alloy or other metal. In particular, the present invention relates to an extrusion press having a shear device cutting off a discard of a remaining part of a billet from an extruded product wherein a container is made to separate from a die after extrusion and the shear device cuts off the discard at the surface of the die.

BACKGROUND ART

In general, when extruding a metal material, for example, a billet of aluminum or an alloy material of the same, by an extrusion press, the following apparatus is used for the extrusion. An extrusion stem is attached to a front end part of a main ram driven by a hydraulic cylinder. In a state with a container pressed against a die stack, the billet is placed in the container by the extrusion stem etc. Further, the main ram is made to further advance by the drive operation of the hydraulic cylinder. Due to this, the billet is pushed by the extrusion stem. Therefore, a shaped product is extruded from an outlet part of the die stack.

In the shear device of the extrusion press of PLT 1, to maintain the sharpness of the shear knife, it was necessary to sufficiently fasten the die stack. For this reason, the practice had been to use something like a hydraulic cylinder. If using a hydraulic cylinder or other hydraulic circuit, there was trouble such as degradation of the hydraulic fluid and leakage of fluid from the piping joints. This causes a problem in terms of the environment and maintenance costs. Also, there was an accompanying risk of fire at the time of operation and time of maintenance. Further, to fasten the die stack in the horizontal direction or vertical direction and make a shear slide engage in a rocking motion, a large hydraulic force was required from the hydraulic cylinder, so the drive device became larger.

CITATION LIST

Patent Literature

PLT 1: Japanese Unexamined Patent Publication No. 2013-91071A

SUMMARY OF INVENTION

Technical Problem

In an extrusion press, a booster mechanism using a lever is employed for the purpose of reducing the size of the drive device of the shear device cutting off the discard.

Solution to Problem

An extrusion press comprising a first fastening part of a die stack fastening the die stack by pressing it in a cutting direction of a discard and a second fastening part of a die stack fastening the die stack by pressing it in an extrusion direction of a billet and comprising a shear device cutting off a remaining part of the billet forming the discard, forming the two fastening parts pressing the die stack by booster mechanisms using levers, comprising a third fastening part fastening the die stack in the extrusion direction by pressing a shear guide against a horseshoe, and forming a tilting mechanism of the shear guide able to hold a clearance between a surface of the die stack and the shear knife constant by a booster mechanism using a lever.

The booster mechanism using a lever can be made a mechanism using an electric motor, electric powered cylinder (electric motor with built-in ball screw), or air cylinder.

The drive device of the shear slide can be made an electric motor.

Advantageous Effects of Invention (1) According to the present invention using a booster mechanism, it is possible to use an air cylinder or electric motor (from which, in the past, a large thrust could not be expected) to generate a thrust corresponding to a hydraulic cylinder. Due to this, it is possible to stop using a hydraulic drive and make the apparatus smaller in size. Also, there is no worry over fluid leakage and it is possible to eliminate the risk of fire at the time of operation and at the time of maintenance.

(2) In the prior art, in the second fastening part fastening the die stack in the horizontal direction, it was necessary to use two cylinders at a top and bottom of a center axis of the extrusion press. In the present invention, the cylinder 42 for tilting the shear slide is served as a top cylinder, so the top cylinder becomes unnecessary. Due to this, there are the advantageous effects of leading to a reduction in the number of parts and contributing to conservation of resources.

(3) By using an electric motor for the shear drive device, the apparatus becomes lower in height and the machine as a whole becomes more compact compared with the conventional case of using a hydraulic cylinder. Furthermore, a greater energy saving effect is obtained compared with the conventional case of using a hydraulic cylinder.

BRIEF DESCRIPTION OF DRAWINGS

FIGS. 3*a* and 3*b* are schematic views of a vertical die clamp device of the present invention as seen from the X-X direction of FIG. 2, wherein FIG. 3*a* is a view showing the state where a vertical die clamp device has clamped a die stack 4 and FIG. 3*b* is a view showing the state where the vertical die clamp device unclamps a die stack 4.

DESCRIPTION OF EMBODIMENTS

The extrusion press of the present invention has a shear device 21 for cutting off a discard. Embodiments according to the present invention will be explained in detail below with reference to drawings using aluminum billet as one example.

First, the extrusion press of the present invention will be explained in brief using FIG. 1. An end platen 1 side is defined as the front while a main cylinder device 2 side is defined as the back. Below, the front surface and back surface will be defined to follow this.

Figure 1:
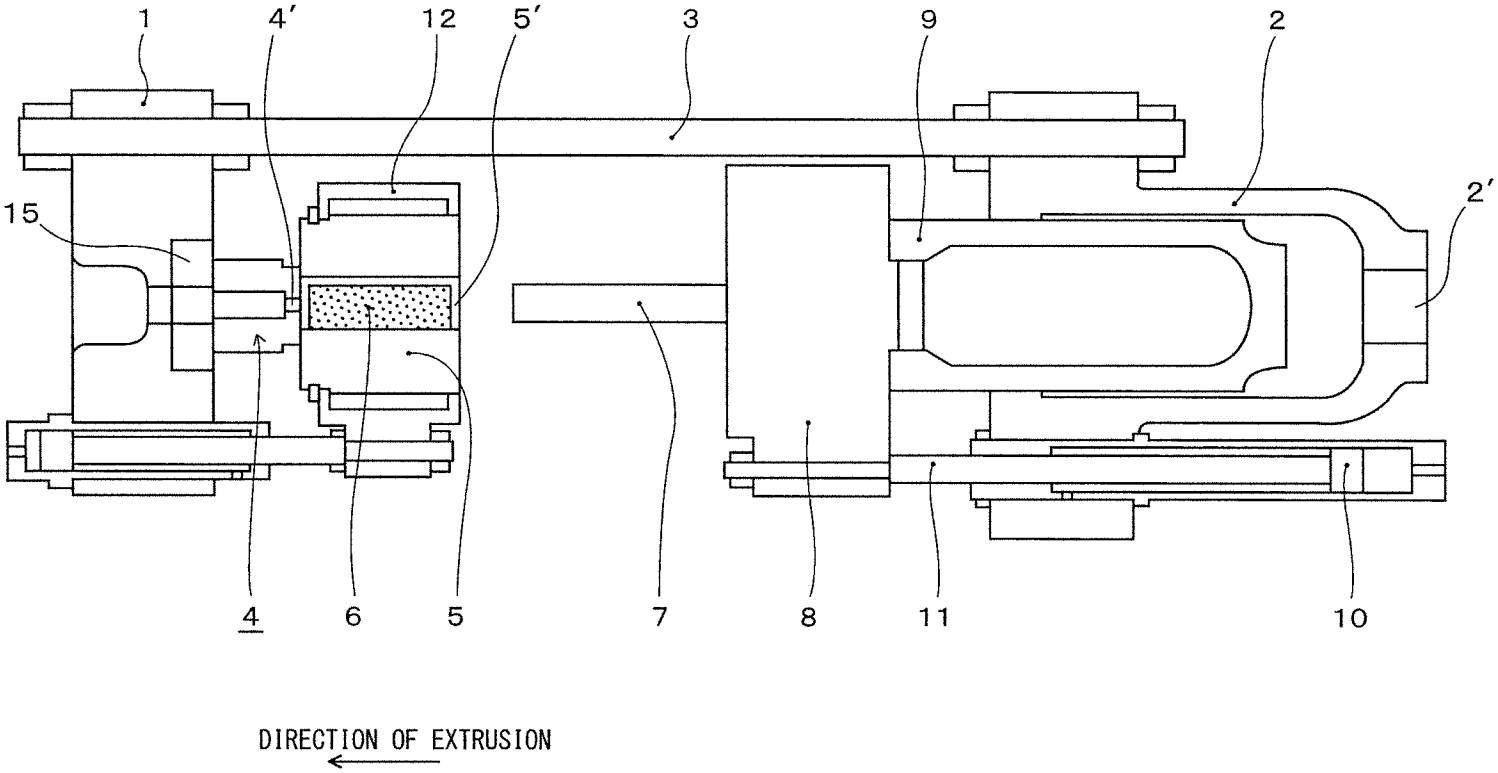
FIG. 1 is a schematic side cross-sectional view showing an extrusion press of the present invention in its entirety.
Figure 4:
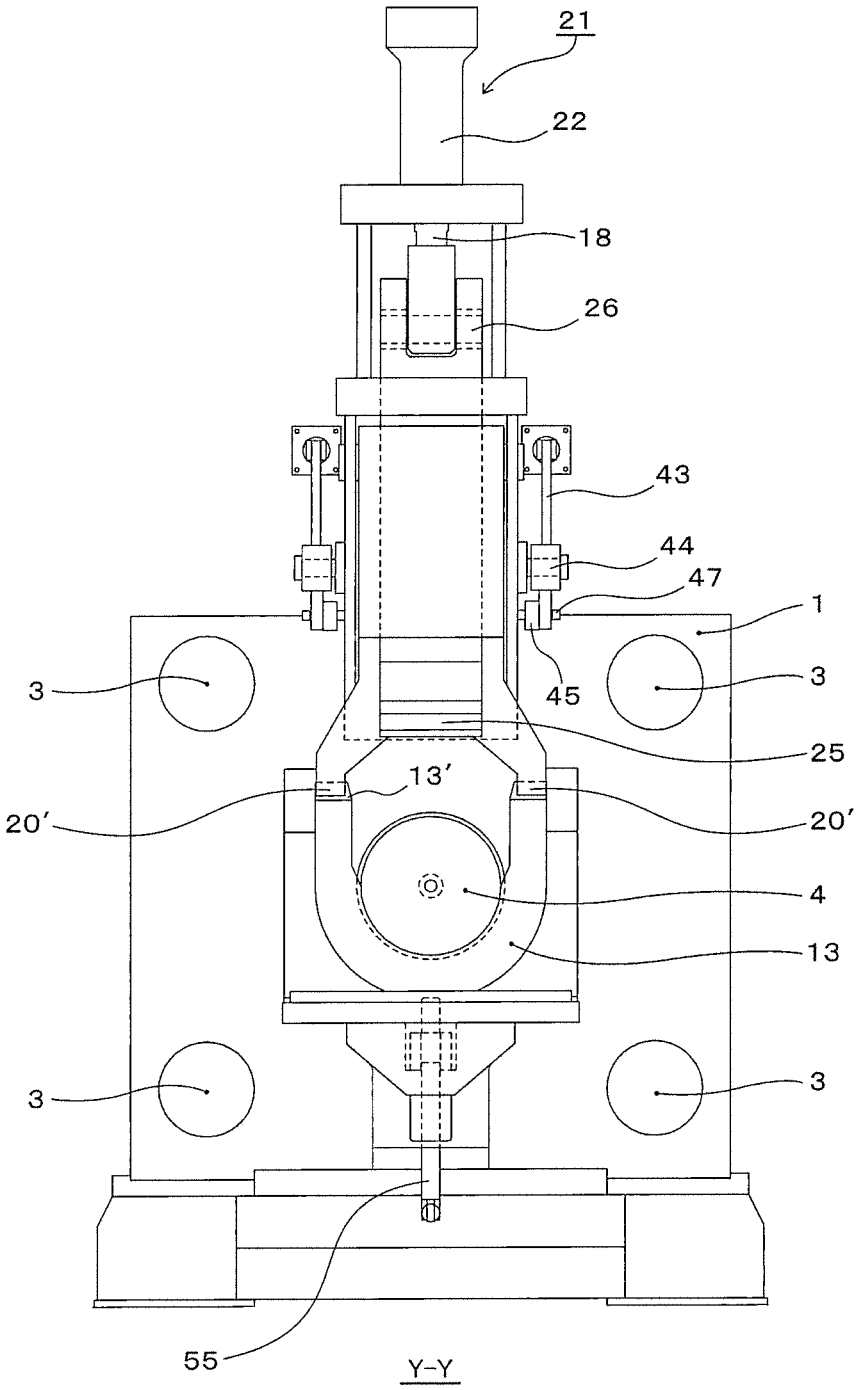
FIG. 4 is a side view of the present invention seen from the Y-Y direction of FIG. 2.

As shown in FIG. 1, the extrusion press used for the present invention arranges the end platen 1 and the main cylinder device 2 facing each other and connects the two by a plurality of tie-rods 3 (FIG. 4 shows four tie-rods 3 at the top, bottom, left, and right). At the inside surface of the end platen 1, an extrusion hole is formed. A die stack 4 is arranged between the extrusion hole and a container 5. By loading a billet 6 into the container 5 and pushing out and pressing this toward the die stack 4, an extrusion material with a cross-section corresponding to the die hole 4' is extruded.

The main cylinder device 2 generating the force for the extrusion action contains a built-in main ram 9 and can press and move this toward the container 5. The hydraulic pressure of the hydraulic cylinder of the main cylinder device 2 is introduced from an opening 2' and makes the main ram 9 operate. At the front end part of this main ram 9, an extrusion stem 7 is attached to a main cross-head 8 facing the container 5 so as to be arranged on the same axis as the billet loading hole 5' of the container 5. Below, this axis will be referred to as the "extrusion center axis". At the front end of the extrusion stem 7, a dummy block (not shown) is attached in close contact.

Therefore, if driving the main cylinder device 2 to make the main cross-head 8 advance, the extrusion stem 7 will be inserted into the billet loading hole of the container 5. The extrusion stem 7 applies pressure to the back end face of the loaded billet 6 and pushes out the extrusion material.

At the main cylinder device 2, a plurality of side cylinders 10 are attached in parallel to the extrusion center axis. The cylinder rods 11 of the side cylinders 10 are connected to the main cross-head 8. Due to this, as a preparatory process of the extrusion process, the extrusion stem 7 is made to initially move to a position closer to the container 5, and a pushing and pressing operation is made to be performed using both of the main cylinder device 2 and side cylinders 10.

First Embodiment

Figure 2:
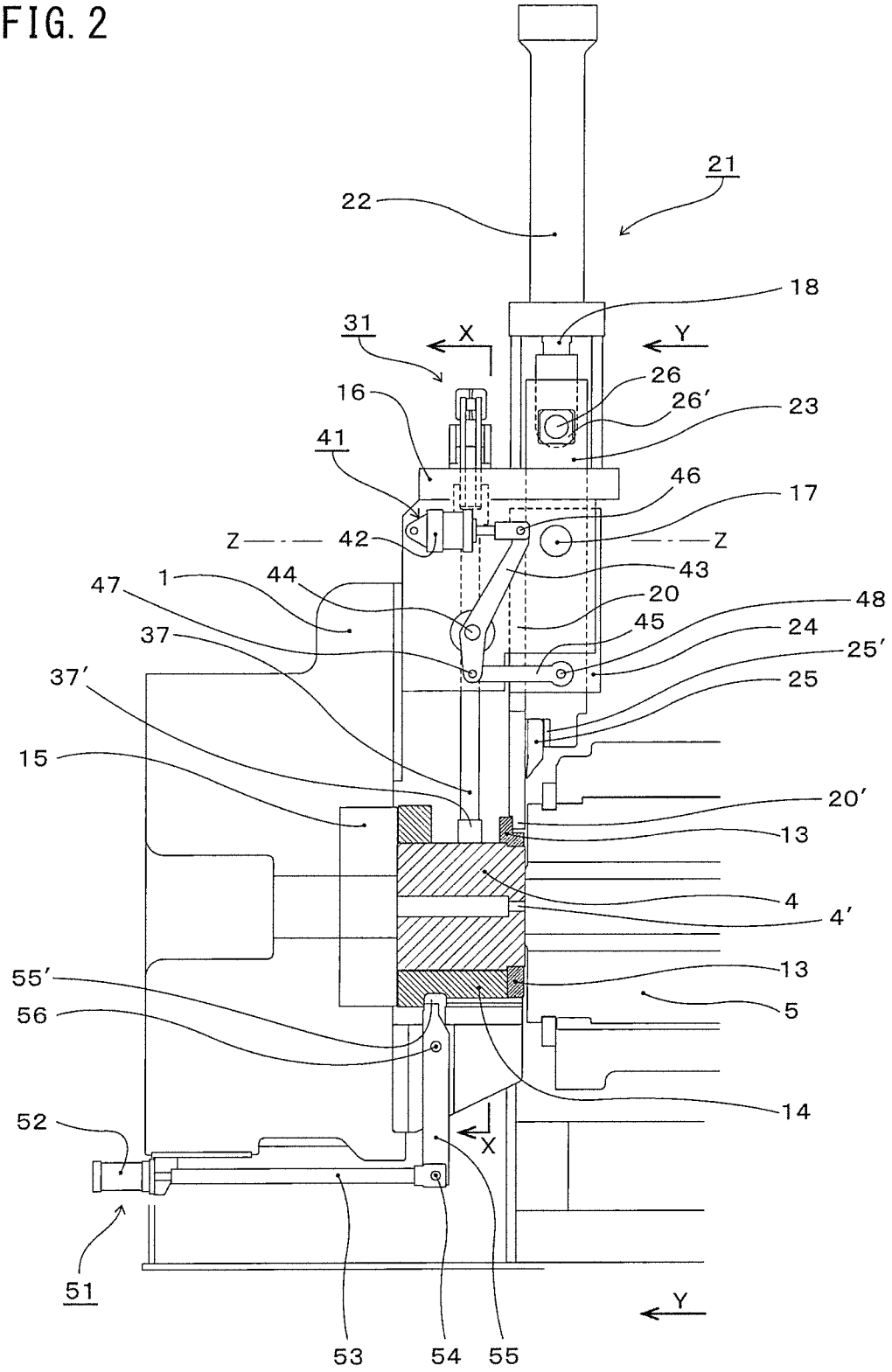
FIG. 2 is a side view of a shear device of the present invention as a whole.

Next, using FIGS. 2 to 7, a first embodiment of the present invention will be explained. In FIG. 2, 1 is an end platen, 4 a die stack, 14 a die block, and 15 a pressure ring. The pressure ring 15 is provided inside the end platen and receives a pressing force from the die stack 4. At the center part of the pressure ring 15 and the end platen 1, an extrusion hole, through which the product extruded from the die stack 4 can pass, is provided. The die stack 4 is comprised of a not-shown plurality of parts.

Figure 5:
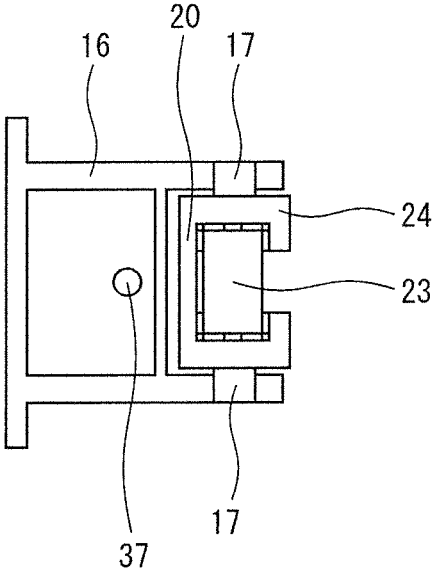
FIG. 5 is a cross-sectional view of a shear frame 16 and a shear guide 24 along a line Z-Z of FIG. 2.

At the top container side (back side) of the end platen 1, a shear frame 16 is attached by connecting and fastening it there. The end platen 1 holds the die stack 4 at the back by a later explained fastening part. At the top end part of the shear frame 16, a shear cylinder 22 for cutting off the discard is attached. As shown in FIG. 5, at part of the shear frame 16, a shear guide 24 is attached to be able to turn by a shaft 17 fixed to a shear guide 24 and rocks in both the extrusion direction and anti-extrusion direction.

Reference numeral 18 indicates a piston rod. At a shaft 26 at the bottom tip of the piston rod 18, the shear slide 23 is pivotally attached. It is attached so that if the piston rod 18 is driven, the shear slide 23 connected by the shaft 26 freely slides up and down inside the shear guide 24. When the shear guide 24 rocks about the shaft 17, the piston rod 18 cannot rock. For this reason, the shaft 26 is attached to the slide 26'. The slide 26' slides with respect to the shear guide 24 inside an elongated hole provided at the shear slide 23. Reference numeral 25 is a shear knife which cuts off the discard. Further, reference numeral 5 is the container in which a billet is inserted. The extrusion press of the present embodiment includes a main cylinder device 2 including an end platen 1, a die stack 4, container 5, and extrusion stem 7, and a shear device 21 cutting off the discard of the remaining part of the billet.

Figure 3A:
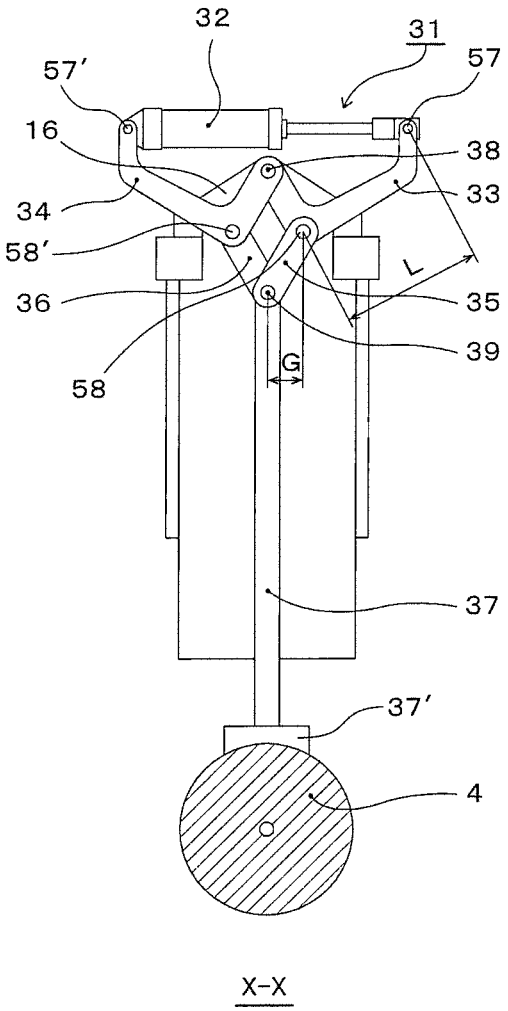

The die stack 4 is housed in the die block 14. A die cassette comprised of the die stack 4 and die block 14 is pressed in the end platen direction (forward) by a later explained third fastening part of the shear guide push device 41 and the later explained second fastening part 51. The die stack 4 is restricted in movement in the horizontal direction between the pressure ring 15 and the horseshoe 13. In the second fastening part 51, an air cylinder 52 fastens the die stack 4 to the end platen 1 through a die clamper 55 and a shaft 56 (second booster mechanism). The die clamper 55 turns about the shaft 56 as a lever. The tip of the cylinder rod 53 of the air cylinder 52 and one end of the die clamper 55 are pivotally attached by a shaft 54. The other end of the die clamper 55 is inserted into a groove 55' provided at the bottom surface of the die block 14. If the piston rod 53 extends at the air cylinder 52, due to the lever principle, the other end of the clamper 55 presses against the front side of the groove 55' while being boosted and presses the die stack 4 surrounded by the horseshoe 13 against the pressure ring 15. At the same time, as shown in FIG. 3*a*, in the vertical direction, due to the pressing force of the bottom end part 37' of the die clamper 37, the die stack 4 is fastened in the vertical direction too, as the first fastening part. The die clamper 37 operates by the die stack air cylinder 32.

The die stack 4 is set thicker in the extrusion direction than the die block 14. For this reason, even if the thickness fluctuates due to heat expansion of the die stack 4 etc., it is possible to constantly strongly fasten the die stack 4 against the back surface of the end platen 1.

Figure 6:
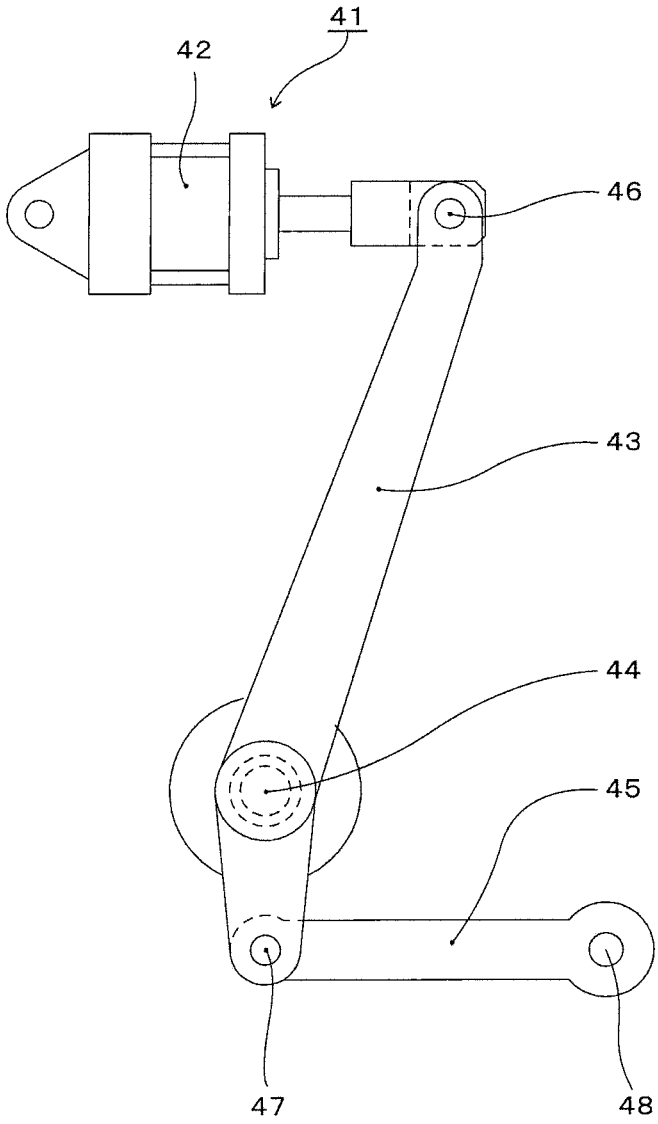
FIG. 6 is a partial enlarged view of a rocking mechanism of a shear guide 24 of a shear device of the present invention.

The bottom end 20' of the shear guide 24, as shown in FIG. 4, is an end part extending from the front side plate 20 (FIG. 5) of the shear guide 24 and branching into two below that. This bottom end part 20' (die stack side surface) presses against the two open ends 13' of the horseshoe 13 (container side surfaces) due to the rocking use air cylinder 42. As shown in FIG. 6, the tip of the piston rod of the air cylinder 42 is pivotally attached to one end of the connecting rod 43 by a pin 46, while the connecting rod 43 turns about the lever fulcrum 44 (referred to as third booster mechanism). The other end of the connecting rod 43 is pivotally attached to a pull rod 45 by a pin 47. The pull rod 45 is pivotally attached by a pin 48 to the shear guide 24. If driving the air cylinder 42, the connecting rod 43 functions as a lever. The boosted force can be transferred so that the shear guide 24 rocks. This boosted force is transferred through the bottom end part 20' of the shear guide 24 to the open end parts 13' of the horseshoe 13. In this way, the horseshoe 13 presses the die stack 4 against the pressure ring 15, so the clearance between the position of the shear surface side of the die stack 4 and the passing surface of the shear knife 25 can be made a predetermined value commensurate with the shear. While cutting off the discard after the extrusion, by the later explained pressing in the horizontal direction and pressing in the vertical direction, the die stack 4 can be held constantly at the same position without moving. A shear knife 25 for cutting off the discard is attached to the end of the shear slide 23. This shear slide 23 is held in the shear guide 24. The shear guide 24 rocks about the shaft 17 as the fulcrum and the shear slide 23 can move up and down inside the shear guide 24.

Referring to FIG. 2, a second fastening part constituted by the horizontal die clamp device 51 will be explained.

The horizontal die clamp device 51 is comprised of an air cylinder 52, a push rod 53, a pin 54, a die clamper 55, and a fulcrum 56. The die clamper 55 functions to clamp the die block 14 in the end platen direction. Note that another second fastening part using a lever may also be provided.

Further, the die clamper 55 is designed so that the distance between the fulcrum 56 and pin 54 becomes larger than the distance between the contact point of the die block 14 (front side of groove 55') and the fulcrum 56. For this reason, due to the lever principle, the force by which the die clamper 55 can clamp the die block 14 can be made sufficient even with the air cylinder 52. During the operation for starting extrusion, the extruded product bends etc., so fixing a product at a puller device was a task for a human worker. In the prior art, in back of the end platen, two top and bottom cylinders with used at diagonal positions of the extrusion center for fastening the die stack horizontally. While work by a human worker was possible, the work space became somewhat cramped. On the other hand, in the present embodiment, the push rod 53 and the die clamper 55 are arranged at the center part of the extrusion press which is unrelated with the work space, so it is possible to remarkably improve the work efficiency in manual work to set up an extrusion operation etc.

Further, as explained above, the die stack 4 is pressed to the front by the second fastening part 51 and the third fastening part constituted by the shear guide pushing device 41. In the present embodiment, the die clamper 55 supports the die stack 4 at one point below, and two bottom end parts 20' of the shear guide 24 support the same at two points above. In this way, the die stack 4 is supported with a good balance at three points. It is possible to press the die stack 4 against the pressure ring 15 more uniformly and effectively than the two-point support on the diagonal of the prior art. Furthermore, the vicinity of the die stack 4 is high in temperature, so is an environment unsuitable for installing an electric motor or cylinder. In the prior art, the air cylinder for rocking use had to be set at the bottom end part of the shear guide, that is, in the vicinity of the high temperature die stack 4. As opposed to this, in the present embodiment, the rocking use air cylinder 42 can be installed at an upper position with no heat affect through the lever constituted by the connecting rod 43, so it is possible to improve the installation environment of the air cylinder 42 etc. and better raise the reliability of the control equipment.

Figure 3B:
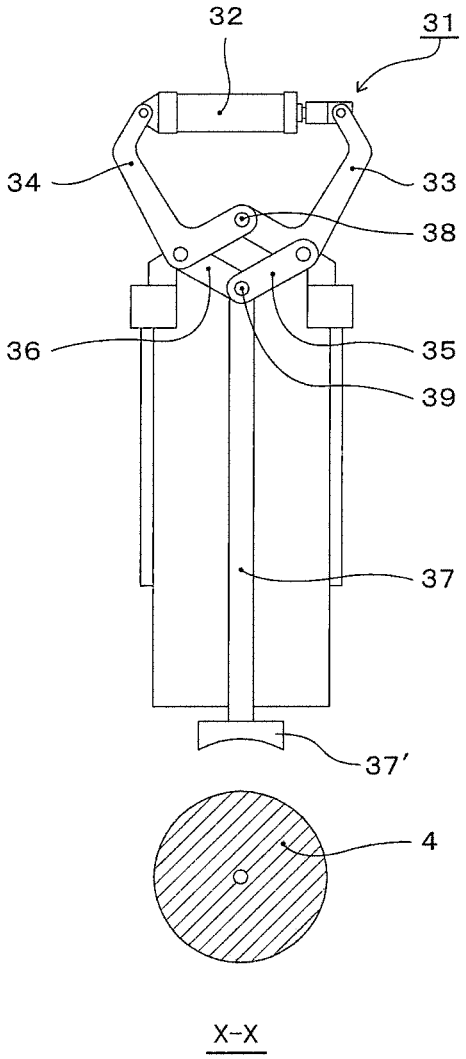

Next, referring to FIGS. 3*a* and 3*b*, a first fastening part constituted by a vertical die clamp device 31 will be explained.

The vertical die clamp device 31 is comprised of an air cylinder 32, large connecting rods 33, 34, small connecting rods 35, 36, a die clamper 37, and a fulcrum 38 (referred to as "first booster mechanism"). The vertical die clamp device 31 forms a toggle link mechanism. The die clamper 37 functions to clamp the die stack 4 in a downward direction. The tip of the rod of the air cylinder 32 is pivotally attached to the large connecting rod 33 by a shaft 57, while the other side is pivotally attached to the large connecting rod 34 by a shaft 57'.

The clamp force W generated at the die clamper 37 becomes W=F*L/G where the pressing force of the air cylinder is F. Based on the lengths of L and G, a large clamp force can be generated. Here, L is the length of the arm of the large connecting rod 33, while G is half of the length of the diagonal 58-58' of the parallel link formed by the fulcrums 38, 39, 58, 58'. The diagonal line 58-58' indicates the horizontal direction, while the diagonal line 38-39 indicates the vertical direction.

Due to this, due to the lever principle, the force by which the die clamper 37 clamps the die stack 4 can be made sufficient even by an air cylinder 31.

Note that the present invention is not necessarily limited to the above-mentioned toggle link mechanism of the present embodiment. It is sufficient to set the toggle link mechanism of the die clamp device 31 to match the direction of movement of the die clamper 37. If the direction of the pressing force of the air cylinder and the direction of movement of the die clamper 37 are suitably selected, other booster mechanisms can also be employed.

Figure 7:
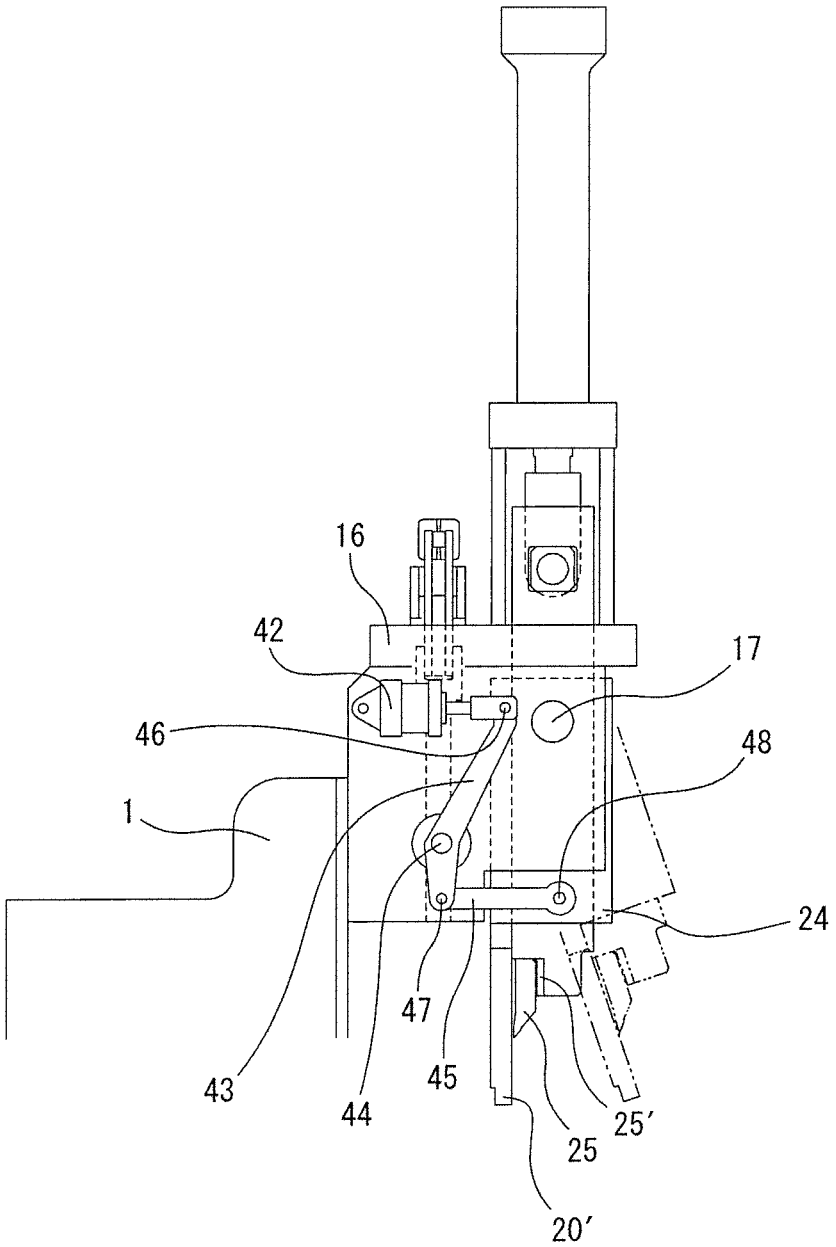
FIG. 7 is an explanatory view showing a rocking motion of the shear guide 24 of the present invention.

Next, referring to FIG. 2, FIG. 6, and FIG. 7, a third fastening part constituted by a shear guide pushing device 41 will be explained.

The air cylinder 42 of the shear guide 24 is used to press the shear guide 24 against the container side end face of the horseshoe 13.

The shear guide push device 41 is comprised of an air cylinder 42, connecting rod 43, fulcrum 44, pull rod 45, pin 46, and pin 47.

Between the distance between the fulcrum 44 of the connecting rod 43 and the pin 47 and the distance between the fulcrum 44 and pin 46 of the air cylinder 42, the latter is larger in this configuration.

Therefore, due to the lever principle, a larger force for pressing the shear guide 24 against the container side end face of the horseshoe 13 can be obtained by even an air cylinder.

Second Embodiment

Figure 8:
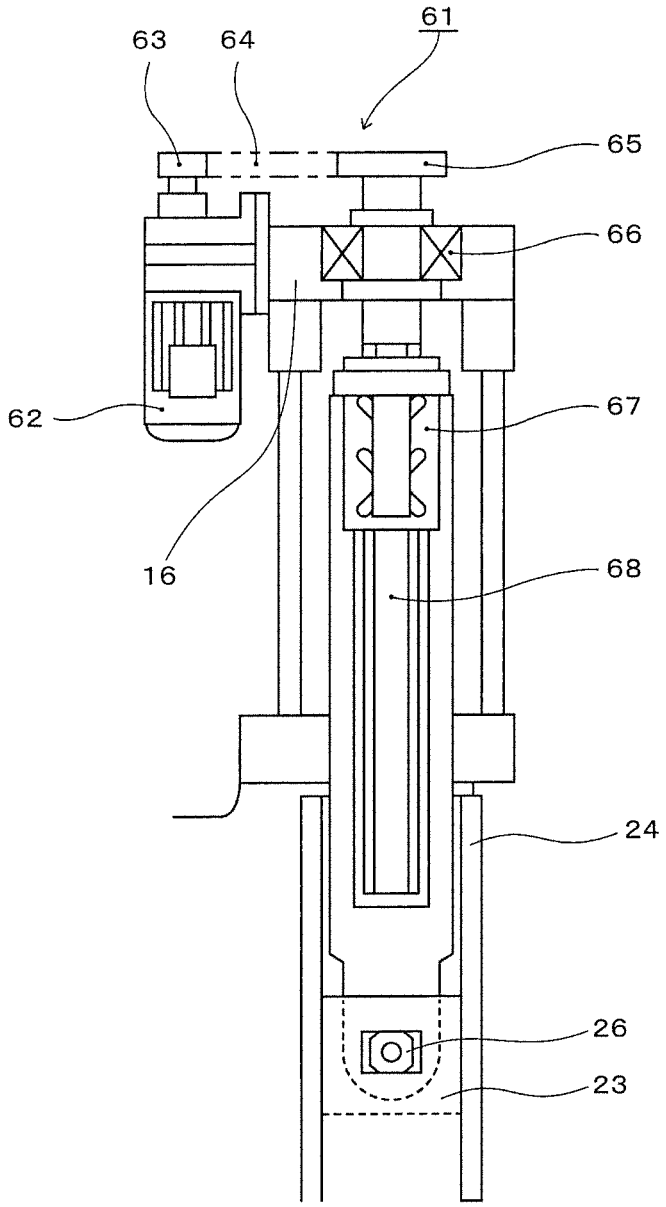
FIG. 8 is a partial explanatory view of the case where the shear drive device of the present invention is made an electric motor.

FIG. 8 shows a second embodiment in a case of using an electric motor for the shear drive device.

The shear drive device 61 of the shear device 21 is mainly comprised of a ball nut 67 attached to a shear slide 23, a ball screw 68 attached to a shear frame 16 to be able to turn through a bearing 66, and a wheel 65 provided at a bearing 66 side end of the ball screw 68. If the ball screw 68 turns, the shear slide 23 ascends or descends along the shear guide 24. The ball screw 68 is turned by the electric motor 62 through the wheel 65, belt 64, and wheel 63. The wheel 65, belt 64, and wheel 63 may also be a chain and sprockets.

By using an electric motor 62 for the shear drive device 61, compared with when using a conventional hydraulic cylinder 22, the apparatus becomes lower in height, the machine as a whole becomes more compact, and energy saving is promoted. The rest of the configuration is the same as the first embodiment.

Next, the actions of the first and second embodiments of the present invention will be explained. First, if the extrusion work ends, as shown in FIG. 2, the container 5 and the extrusion stem 7 (not shown) are made to retract. Next, the container 5 is separated from the die stack 4. This being so, the discard of the remaining part of the billet after extrusion (not shown) appears at the end face of the die stack 4. In this state, the shear knife 25 is at the limit position of rise.

Due to the air cylinder 52 for fastening the die stack horizontally, the air cylinder 32 for fastening the die stack vertically, and the cylinder 42 for rocking of the shear slide, the shear guide 24 is made to move in the extrusion direction until the end of the shear guide 24 is positioned at the horseshoe 13.

Due to this operation, the die stack 4 is fastened before cutting off the discard, and the shear knife 25 can be held at a constant fixed clearance from the surface of the die stack by means of the shear slide 23, shear guide 24, and horseshoe 13. Further, it is possible to adjust the thickness of shims 25' (see FIG. 2) between the shear knife 25 and the shear slide 23 so as to adjust the clearance between the die stack 4 and the shear knife 25.

While holding that state, the shear cylinder 22 is operated to make the shear knife 25 descend. The shear knife 25 cuts off the discard from the product.

In the present invention, the die stack 4 can be fastened to the end platen 1 and die block 14 and tilt of the die stack 4 can be prevented. Furthermore, the shear slide rocks together with the second fastening part 51 and fastens the die stack 4 through the horseshoe 13 at three points, so when cutting off the discard, it is possible to make the shear knife 25 parallel at all times with the surface of the die stack 4 and possible to make thickness of the cut off scraps of the discard uniform.

After cutting off the discard, the air cylinder 42 is operated for making the shear slide rock to make the shear guide 23 turn slightly and separate from the horseshoe 13 and the shear cylinder 22 is operated to make the shear slide 23 and shear knife 25 rise. Due to this, it is possible to make the shear knife rise without any detrimental effect on the die surface due to the scraps of aluminum stuck to the shear knife. Further, at the rising limit, the air cylinder 42 for rocking the shear slide is operated to return the shear guide 24 to the vertical state and the discard cutting process is ended.

(1) According to the present invention using a booster mechanism, it is possible to use an air cylinder or electric motor (from which, in the past, a large thrust could not be expected) to generate a thrust corresponding to a hydraulic cylinder. Due to this, it is possible to stop using a hydraulic drive and make the apparatus smaller in size. Also, there is no worry over fluid leakage and it is possible to eliminate the risk of fire at the time of operation and at the time of maintenance.

(2) In the prior art, in the second fastening part fastening the die stack in the horizontal direction, it was necessary to use two cylinders at a top and bottom of a center axis of the extrusion press. In the present invention, the cylinder 42 for tilting the shear slide is served as a top cylinder, so the top cylinder becomes unnecessary. Due to this, there are the advantageous effects of leading to a reduction in the number of parts and contributing to conservation of resources.

(3) By using an electric motor for the shear drive device, the apparatus becomes lower in height and the machine as a whole becomes more compact compared with the conventional case of using a hydraulic cylinder.

Furthermore, a greater energy saving effect is obtained compared with the conventional case of using a hydraulic cylinder.

REFERENCE SIGNS LIST

1. end platen
2. main cylinder device
3. tie rod
4. die stack
5. container
6. billet
7. extrusion stem
8. main cross-head
9. main ram
10. side cylinder
11. side cylinder rod
12. container holder
13. horseshoe
14. die block
15. pressure ring
16. shear frame
17. shaft
18. cylinder rod
21. shear device
22. hydraulic cylinder
23. shear slide
24. shear guide
25. shear knife
31. vertical die clamp device
32. air cylinder
33. large connecting rod
34. large connecting rod
35. small connecting rod
36. small connecting rod
37. die clamper
38. fulcrum
39. connecting pin
41. shear guide push device
42. air cylinder
43. connecting rod
44. fulcrum
45. pull rod
46. pin
51. horizontal die clamp device
52. air cylinder
53. push rod
54. pin
55. die clamper
56 fulcrum
61. shear device drive device
62. electric motor
63. wheel
64. belt
65. wheel
67. ball nut
68. ball screw

The invention claimed is:

1. An extrusion press comprising:

a die stack having a die hole formed therein;

an end platen arranged adjacent to one side of the die stack;

a container arranged adjacent to the other side of the die stack and holding a billet;

a horseshoe restricting movement of the die stack to the container;

a main cylinder device having an extrusion stem which presses the billet in the container in an extrusion direction;

a shear device cutting off a discard of a remainder of the billet, the shear device comprising a shear slide, a shear knife attached to a leading end of the shear slide, a shear guide guiding the shear slide therein and having two engagement parts engaging with both ends of the horseshoe;

a first fastening device comprising a first booster mechanism having levers, the first fastening device fastening the die stack in a cutting direction of the discard, a second fastening device comprising a second booster mechanism having a lever and arranged below the die stack, the second fastening device fastening the die stack by pressing the die stack against the end platen in the extrusion direction; and a third fastening device comprising a third booster mechanism having levers connected to the shear guide and arranged above the die stack, the third fastening device exerting a force on the shear guide in the extrusion direction, thereby fastening the die stack via the horseshoe by pressing the die stack against the end platen in the extrusion direction;

wherein the shear guide exerts the force from the third fastening device on the both ends of the horseshoe through the engagement parts, while the third fastening device presses the die stack against the end platen through the shear guide and the horseshoe, the device maintains a clearance between a surface of the other side of the die stack and the shear knife at a predetermined value, and the first, second and third devices each comprise an air cylinder or electric motor.

2. The extrusion press according to claim 1, wherein the shear slide in the shear guide is driven by an electric motor.

* * * * *